United States Patent [19]

Hirano et al.

[11] 4,127,427

[45] Nov. 28, 1978

[54] SUPER MILD STEEL HAVING EXCELLENT WORKABILITY AND NON-AGING PROPERTIES

[75] Inventors: Hiroshi Hirano, Nishinomiya; Hiroshi Kobayashi, Kakogun; Jiro Jizaimaru, Kakogawa; Hidenori Shirasawa, Kakogun, all of Japan

[73] Assignee: Kobe Steel, Ltd., Kobe, Japan

[21] Appl. No.: 714,891

[22] Filed: Aug. 16, 1976

[30] Foreign Application Priority Data

Aug. 15, 1975 [JP] Japan ..... 50-99643

[51] Int. Cl.[2] ..... C22C 38/06; C22C 38/28

[52] U.S. Cl. ..... 148/36; 75/124; 75/126 F; 148/12 C; 148/12 F

[58] Field of Search ..... 75/124, 126 F; 148/36, 148/12 C, 12 F

[56] References Cited

U.S. PATENT DOCUMENTS

| | | | |
|---|---|---|---|
| 3,574,602 | 4/1971 | Gondo et al. | 75/126 F |
| 3,666,570 | 5/1972 | Korchynsky et al. | 148/36 |
| 3,671,336 | 6/1972 | Korchynsky et al. | 148/36 |
| 3,689,258 | 9/1972 | Zonetti | 75/126 F |
| 3,711,340 | 1/1973 | Korchynsky et al. | 148/36 |
| 4,054,447 | 10/1977 | Tenmyo et al. | 75/124 |

FOREIGN PATENT DOCUMENTS

| | | | |
|---|---|---|---|
| 555,396 | 4/1958 | Canada | 148/36 |
| 46-13495 | 4/1971 | Japan | 148/36 |

*Primary Examiner*—Arthur J. Steiner

*Attorney, Agent, or Firm*—Oblon, Fisher, Spivak, McClelland & Maier

[57] ABSTRACT

The present invention relates to a super mild steel (a very low yield point steel) having excellent workability and nonaging properties, which consists of in weight percent up to 0.07% C, up to 0.5% Si, up to 0.5% Mn, of 0.005 to 0.1% Al and up to 0.22% [C+1/5(Si+Mn)], and 0.1 to 1.3% Cr when Cr is only added or 0.1 to 1.3% Cr and 0.015 to 0.15% Zr when Cr and Zr are simultaneously added, the balance being iron and inevitable impurities.

3 Claims, 5 Drawing Figures

(1): ABNORMAL GRAIN GROWTH TEMPERATURE REGION (2): REGION OF OPTIMUM COILING TEMP. TO PROVIDE NON-AGING PROPERTY (3): MINIMUM REQUIRED COILING TEMPERATURE

SUPER MILD STEEL HAVING EXCELLENT WORKABILITY AND NON-AGING PROPERTIES

BACKGROUND OF THE INVENTION

1. Field of the Invention

The present invention relates to a low yield point steel having excellent workability and non-aging properties, which can be effectively used as a plate (thick steel plate, hot rolled plate and cold rolled plate) or rod (wires, rods and bars) which is subjected to and/or severe forming.

2. Description of the Prior Art

In the process of preparing hot rolled steel plates, a hot rolled band-like steel plate is coiled to form a coil of the steel plate. This coil is marketed directly as a "coil material," after the coil is cut into plates of a certain length, the steel is marketed as a "cut plate material". The hot rolled steel which is marketed is further cut or subjected to forming whereby an article having a shape suitable for the intended object and use is obtained.

In the process of preparing steel rods, a hot rolled rod is subjected to cold drawing, and the resulting steel rod is marketed.

Most of these marketed hot rolled plates and rods or bars are subjected to cold forming to form articles having a shape suitable for the intended use of the article. In the case of hot rolled plates, this cold forming includes deep drawing, bending, bulging and shearing and combinations of these treatments. Rods are subjected to drawing. Accordingly, cold workability is of decisive significance for these steels. The typical characteristics which are indicative of the workability of steel plate are the yield point, elongation, n value (work hardening exponent), r value (Rankford value) and Erichsen value, and the foregoing steel plates must have proper or excellent values with respect to these test items. The property which rods must possess is the low breakage ratio even if the reduction ratio of the rod is high at the drawing step.

In order to improve the cold formability or cold drawability, of the steel a very low carbon aluminum killed steel is employed in the case of hot rolled steel plates, a very low carbon aluminum killed steel or very low carbon decarburized denitrided rimmed steel is employed in the case of cold rolled steel plates and a very low carbon rimmed steel is employed in the case of rods.

However, these steels are posses insufficient yield point characterists which is one of the characteristics which expresses the workability of the steel. In the case of a hot rolled plate of a very low carbon aluminum killed steel, it is very difficult to reduce the yield point below 21-22 Kg/mm$^2$ even after temper rolling, and the lower limit of the yield point of a very low carbon decarburized dentrided rimmed steel is about 18 Kg/mm$^2$.

"Hot rolled steel plate for deep drawing possessing low yield point and non-aging properties has previously been disclosed in" Japanese Patent Application No. 129074/74. As set forth in the claim of the above patent application, the invention relates to a hot rolled steel plate for deep drawing having the low yield point and a non-aging property of the as hot rolled state, which consists in weight percent of 0.03 to 0.07% C, 0.01 to 0.25% Si, 0.2 to 0.5% Mn, 0.015 to 0.07% of Al and 0.03 to 0.1% of Zr exclusive of Zr in its oxide and sulfide forms, the balance being iron and inevitable impurities.

This steel currently on the market and is being put to practical use. Also in this steel plate, the lower limit of the yield point in the as hot rolled state is about 23 Kg/mm$^2$ or higher. Even if such a hot rolled product is heat treated at 950° C. for 1 hour, the lower limit of the yield point is as high as about 20 Kg/mm$^2$.

An age-hardening cold rolled steel plate for deep drawing, which is excellent in the deep drawability, bulging characteristics and other pressformability characteristics and in which a high strength can be imparted by an age-hardening treatment after forming, and the method for preparing such a cold rolled steel are disclosed in the specification of Japanese Patent Application No. 60276/70 (Japanese Patent Publication No. 17013/75.) As set forth in the claims of this application, the application provides (a) an age-hardening cold rolled steel plate for deep drawing which comprises up to 0.01% carbon, 0.08 to 0.6% chromium, 0.05 to 0.4% manganese and 0.009–0.02% nitrogen and is free from aluminum as an effective component, the balance being iron and inevitable impurities, and (b) a process for preparing age-hardening cold rolled steel plates for deep drawing, which comprises subjecting a steel comprising up to 0.01% carbon, 0.08 to 0.6% chromium, 0.05 to 0.4% manganese and 0.009 to 0.02% nitrogen and being free of aluminum as an effective component, with the balance being iron and inevitable impurities, to hot rolling and cold rolling according to customary procedures, annealing the resulting steel plate at a temperature of 700° C., to the $Ac_3$ point and cooling the annealed steel plate to room temperature from about 500°-600° C. at a cooling rate of 100° to 500° C. per hour.

In the steel plate (a) of the above prior art, nitrogen and chromium are incorporated in a very low carbon rimmed steel, and a crystal arrangement suitable for deep drawing of the cold rolled steel plate is formed by the combined effects of nitrogen and chromium. The nitrogen content is higher than 0.009%, and the chromium content is changed depending on the nitrogen and carbon contents and it is, for example, 0.15 to 0.25% when the nitrogen content is 0.01%.

When the steel of the present invention (referred to as "the former steel") is compared with the above steel of the prior art (referred to as "the latter steel"), it is apparent that both steels are quite different from each other. More specifically, the former steel is a hot rolled, steel plate which possesses good press-formability and non-aging properties, whereas the latter steel is a cold rolled steel plate with good press-forming processability and age-hardening properties. Accordingly, it is apparent that both the steels are quite different from each other with respect to the steel composition and characteristics and that the technical concept of the present invention is quite different from that of the above prior art, as described as follows.

As mentioned above, the r value is one of the important characteristics of steel which denotes the formability, especially the deep drawability of the steel. The value can be improved only in the cold rolled steel plate. In the case of a hot rolled steel plate, however, no method has yet been found which improves this value found. Accordingly, another characteristic except value, such as yield point, elongation, and the like, are also important for hot rolled steel plates.

In the automobile industries where large quantities of hot rolled steel plates are used, steel objects of extremely complicated shapes are not required. In order to satisfy these shape requirements, research has been conducted for methods by which hot rolled steel plates possessing very low yield point, properties very high total elongation properites and non-aging properities can be produced. Some of these hot rolled steel plates are now in practical use. One of the current proposals for improving the deep drawability of hot rolled steel plates has been disclosed in, Japanese Patent Application No. 49145/67 (Japanese Patent Publication No. 13/74). As described and illustrated in the claim the specification and the accompanying drawings of the application, the invention resides in a process for the preparation of hot rolled steel plates which possess non-aging properties for the further for cold press forming of the hot rolled steel plates being composed of an aluminum killed low carbon steel comprising up to 0.12% by weight of C, 0.15 to 0.60% by weight of Mn, 0.01 to 0.15% by weight of sol. Al and 0.0040 to 0.0100% by weight of N with the balance being iron and inevitable impurities, said process being characterized by measuring the sol. Al content in the steel, and adjusting the temperature for coiling the hot rolled steel plate to a temperature corresponding to the measured sol. Al content in a region ABCD in FIG. 5 or reheating the hot rolled steel at a temperature of 600° to 700° C., for at least 1 hour after coiling, whereby N in the steel plate is precipitated in the form of AlN and precipitation of large carbides is reduced as much as possible.

According to the disclosure prior art reference, in a hot rolled low carbon aluminum killed steel plate, the AlN precipitation range which provides the highest cold press-formability and non-aging properties is set by adjusting the sol. Al content in the steel and the coiling temperature. The yield point, however, is not included in the specification of the reference. The lowest tensile strength illustrated is about 35 kg/mm$^2$, and it is estimated that the yield point of a hot rolled steel plate having such a tensile strength may be in the range of 23 to 25 Kg/mm$^2$. Accordingly, it is believed that the hot rolled steel plate derived from the prior art procedure fails to completely satisfy the requirements for steel plates of this type.

SUMMARY OF THE INVENTION

It is a primary object of the present invention to provide a steel having excellent workability and non-aging properties, which can be effectively used as a plate or rod which is subjected to complicated and/or severe forming.

A secondary object of the present invention is to provide a hot rolled steel having a very low yield point.

In accordance with the first aspect of the present invention, which attains the foregoing objects, a low yield point steel having excellent workability and non-aging properties is provided, which consists in weight percent of up to 0.07% C, up to 0.5% Si, up to 0.5% Mn, 0.005 to 0.1% Al and 0.1 to 1.3% Cr, preferably 0.3 to 0.7% Cr, the balance being Fe and the inevitable impurities, wherein the value of [C + 1/5 (Si + Mn)] is up to 0.22%.

In accordance with the second aspect of the present invention, a low yield point steel having excellent workability and non-aging properties is provided, which consists in weight percent of up to 0.07% of C, up to 0.5% Si, up to 0.5% Mn, 0.005 to 0.1% Al, 0.1 to 1.3% Cr, preferably 0.3 to 0.7% Cr and 0.015 to 0.15% Zr, the balance being Fe and the inevitable impurites, wherein the value of [C + 1/5 (Si + Mn)] is up to 0.22%.

In accordance with the third aspect of the present invention, a steel as set forth in the first aspect is provided which contains a carbonitride of Cr in the ferrite grain.

In accordance with the fourth aspect of the present invention, a steel as set forth in the second aspect is provided which contains carbonitrides of Cr and Zr in the ferrite grain.

In accordance with the fifth aspect of the present invention, a steel as set forth in the first or second aspect is provided, which is hot rolled and then subjected to a reheating-treatment at 900° to 1,100° C. followed by slow cooling at a cooling rate not higher than 200° C. per hour.

DETAILED DESCRIPTION OF THE PREFERRED EMBODIMENTS

Figure 1:
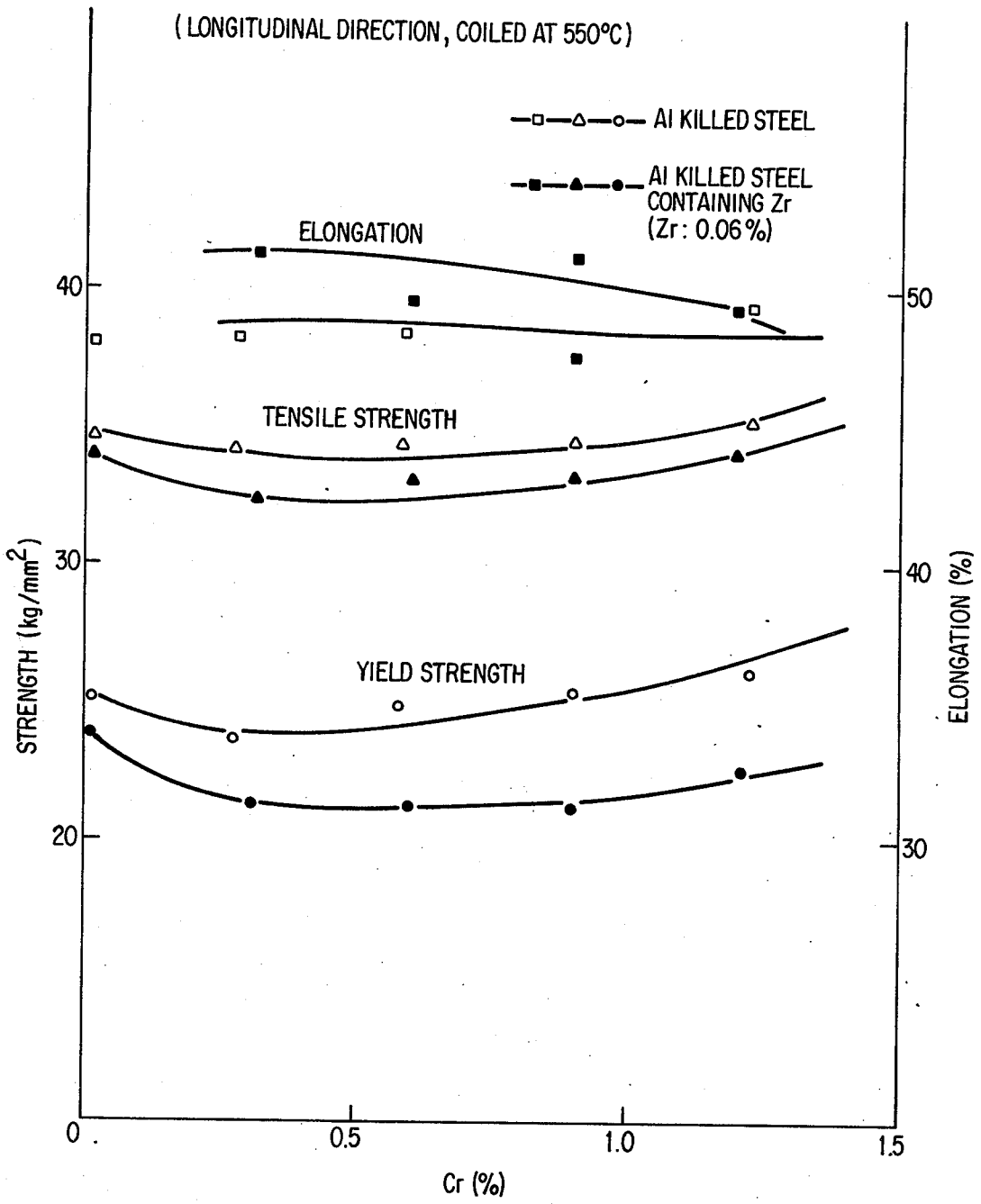
FIGS. 1 to 2 illustrate the relationship between the mechanical properties of hot rolled coils which have been coiled at 550° C., and the chromium content, said relationship observed either when Zr is incorporated in an aluminum killed steel or when Zr is not incorporated in an aluminum killed steel said, FIG. 1 showing the tensile test values in the longitudinal direction and said FIG. 2 showing the tensile test values in the lateral direction.

According to the present invention, the Si content of a low carbon aluminum killed steel is reduced as much as possible, and Mn is incorporated in the steel in such an amount that will prevent hot shortness by S in the hot rolling step. P is inevitably present as an element which is solid-dissolved in the ferrite structure of the steel and increases the strength of the steel. Therefore, the upper limits of these elements are maintained at levels as low as possible. In this type of basic steel composition, 0.10 to 1.30% Cr is optionally incorporated with 0.015 to 0.15% Zr, in the steel whereby the solid solution softening effect of Cr is manifested and the yield point of the steel is lowered. As a result, the formability of the steel can be substantially improved.

As is well known in the art, in general, when a metal is alloyed with another metal, the strength is increased. However, in the case of an iron base alloy, if Si, Mn, Ni or Cr is incorporated within the alloy, it is believed that when the concentration of the alloy element is low, so called "solid solution softening" takes place in a certain temperature region. This phenomenon reduces the strength of iron and lowers the yield point. In the case of Cr, the temperature which causes solid solution softening is room temperature. This characteristic is not observed in any of Si, Mn and Ni. The theoretically mechanism for solid solution softening has not been elucidated, but it has been empirically confirmed that the phenomenon of solid dissolution softening is caused by the foregoing elements.

Cr and Zr, which are important elements in the present invention, are precipitated as carbonitrides by reheating steel at a temperature of 900° to 1100° C., and these elements act as carbon and nitrogen getters (reduced carbon and cementite present on the grain boundary) which participate in the increasing of the yield point. Further, Cr in the solid solution has a solid solution softening effect of lowering the yield point and renders the steel non-aging.

The Cr content is changed depending on the carbon content. In general, chromium carbide is present in the steel in the form of $Cr_7C_3$. Accordingly, for example, in the case of a steel containing 0.01% C, the necessary amount of Cr is about 0.10%, and as the C content is increased, the Cr content must be increased. In order to manifest the characteristic phenomenon of solid solution softening, it is necessary to incorporate at least 0.10% Cr within the steel. However, if the Cr content exceeds 1.30% solid solution hardening takes place instead. Accordingly, the Cr content is adjusted in the range of from 0.10 to 1.30%.

The reasons for limiting the of contents of the respective elements in the present invention will now be described.

C is an element which not only increases the yield point, but also the strength. The characteristic feature of the present invention, namely the low yield point, is improved as the C content is lowered. However, in view of the limit of the steel manufacturing technique and the manufacturing cost, the upper limit of the C content is specified as 0.07%.

Si is an element which increases the yield point by solid solution. In order to achieve a steel of low yield point, which is the characteristic feature of the present invention, it is preferred that the Si content of the steel be as low as possible. Further, Si forms an oxide in the steel and forms an "A" type inclusion specified in JIS G-0555, thus reduces the formability of the steel. Accordingly, the upper limit of the Si content is specified as 0.5%.

Mn is an element which increases the yield point as well as C and Si. In order to obtain a low yield point, which is the characteristic feature of the present invention, it is preferred that the Mn content be as low as possible. However, Mn is an element which is necessary to prevent hot shortness by S is the hot rolling step. Accordingly, the upper limit of the Mn content is specified as 0.50%.

Cr is a most important element among the elements incorporated into the steel of the present invention. In order to sufficiently fix carbon dissolved in the steel and in order to promote solid solution softening, the lower limit of the Cr content is specified as 0.10%. If the Cr content exceeds 1.30%, the phenomenon of solid solution hardening takes place and the intended low yield point steel of the present invention cannot be obtained. Accordingly, the upper limit of the Cr content is specified as 1.30%. Further, Cr is linked with nitrogen dissolved in the steel to form chromium nitride CrN which imparts non-aging properties to the steel. A preferred Cr content is in the range of from 0.3 to 0.7%.

Zr is an element which fixes the carbon and nitrogen dissolved in the steel to form a carbonitride of Zr which imparts non-aging properties to the steel. In order to fix the nitrogen which intrudes in the steel from the air, the desired fixing effect can be attained when the Zr content is at least 0.015% and as the Zr content is increased, the effect is enhanced. However, even if the Zr content exceeds 0.15%, no substantial improvement of the effect is attained. Further, Zr is expensive, and use of a large amount of Zr raises the price of the steel. Therefore, in the steel of the present invention, the Zr content is maintained in the range of from 0.015 to 0.15%.

If the [C% + 1/5 (Si% + Mn%) value exceeds 0.22%, the formability of the steel of the present invention is degraded and the yield point is increased. Accordingly, the upper limit of the above value is specified as 0.22%.

Al is an element which possesses a deoxidizing activity. If the Al content is less than 0.005%, the desired effect is not manifested in the present invention. Therefore, the lower limit of the Al content is specified as 0.005%. If the Al content exceeds 0.1%, Al is dispersed in the form of a "B" type inclusion specified in JIS G-0555 as a result of deoxidation. Thus, the formability of the steel is degraded, and this inclusion is distributed on the surface of the steel ingot and worsens the surface conditions when the ingot is formed into an article. Accordingly, the upper limit of the Al content is specified as 0.1%.

Since the steel manufacturing and pouring steps are conducted according to customary procedures, N is unavoidably incorporated in the steel.

N, P and S are inevitable elements which are present in the steel. N and P are dissolved in the steel to increase the yield point. Accordingly, it is preferred that the N and P content be as low as possible. S causes hot shortness in the hot rolling step. According, if the S content is high, it is necessary to increase the content of Mn which hinders the attainment of the low yield point intended in the present invention. Accordingly, it is preferred that the S content be as low as possible. Furthermore, in order to reduce the anistropy generally observed in ordinary hot rolled steel plates, it is preferred that the S content be reduced as much as possible.

The feature of the present invention that the hot rolled steel is reheated at a temperature of 900° to 1100° C. will now be described by reference to FIG. 4.

In a steel containing 0.55% Cr (sample No. 2) and a steel simultaneously containing 0.59% Cr and 0.052% Zr (sample No. 5), a tendency is observed that as the reheating temperature is elevated, the yield point is lowered which becomes conspicuous when the reheating temperature is elevated to 800°-900° C. The lowering of the yield point is substantially saturated when the temperature is 900° to 1100° C. Accordingly, in the present invention the reheating temperature is specified as in the range of from 900° to 1100° C.

After the reheating treatment, the steel is slowly cooled at a cooling rate not higher than 200° C. per hour. At a higher cooling speed, quenching hardening takes place.

Having generally described the invention, a more complete understanding can be obtained by reference to certain specific examples, which are provided herein for purposes of illustration only and are not intended to be limiting unless otherwise specified.

Table 1 shows the chemical compositions of steels of the present invention (sample Nos. 1 to 8) and comparative steel samples (sample Nos. 9 to 11). Steels having the indicated chemical composition were melted in the open air by an L-D converter (240 tons per melt), and an ingot mass was prepared according to a customary pouring method and the ingot mass was formed into 12 flat ingots, each having a weight of 20 tons. In this example, ingots were prepared according to a customary pouring method. However, it is possible to use ingots prepared by continuous casting.

TABLE 1

| Sample Number | C% | Si% | Mn% | P% | S% | Al% | N% | Cr% | Zr% |
|---|---|---|---|---|---|---|---|---|---|
| 1 | 0.04 | 0.04 | 0.33 | 0.012 | 0.014 | 0.017 | 0.0065 | 0.29 | — |
| 2 | 0.04 | 0.03 | 0.30 | 0.012 | 0.014 | 0.023 | 0.0062 | 0.55 | — |
| 3 | 0.04 | 0.05 | 0.30 | 0.012 | 0.014 | 0.020 | 0.0055 | 0.88 | — |
| 4 | 0.04 | 0.02 | 0.30 | 0.012 | 0.014 | 0.028 | 0.0066 | 1.13 | — |
| 5 | 0.05 | 0.03 | 0.30 | 0.012 | 0.012 | 0.032 | 0.0068 | 0.59 | 0.052 |
| 6 | 0.05 | 0.05 | 0.30 | 0.012 | 0.014 | 0.034 | 0.0072 | 0.86 | 0.055 |
| 7 | 0.04 | 0.02 | 0.29 | 0.012 | 0.013 | 0.028 | 0.0112 | 1.12 | 0.065 |
| 8 | 0.04 | 0.03 | 0.29 | 0.011 | 0.013 | 0.037 | 0.0058 | 0.31 | 0.04 |
| 9 | 0.05 | 0.05 | 0.31 | 0.013 | 0.014 | 0.035 | 0.0063 | — | — |
| 10 | 0.04 | 0.03 | 0.28 | 0.014 | 0.014 | 0.032 | 0.056 | — | — |
| 11 | 0.04 | 0.02 | 0.25 | 0.012 | 0.014 | 0.022 | 0.0068 | — | 0.04 |

| Sample Number | CHEMICAL COMPOSITION (%) $C + \frac{1}{5}(Si - Mn)$ | Remarks |
|---|---|---|
| 1 | 0.101 | steel of present invention (Cr incorporated) |
| 2 | 0.106 | " |
| 3 | 0.110 | " |
| 4 | 0.104 | " |
| 5 | 0.116 | steel of present invention (Cr and Zr incorporated) |
| 6 | 0.120 | " |
| 7 | 0.102 | " |
| 8 | 0.104 | " |
| 9 | 0.122 | comparison (aluminum killed steel) |
| 10 | 0.102 | " |
| 11 | 0.098 | comparison (Zr incorporated aluminum killed steel) |

The steel of the present invention (sample Nos. 1 to 8) and comparative samples (Nos. 9 to 11) were bloomed and formed into slabs. Each slab was subjected to soaking at 1250° C. for 3 hours, hot rolled and coiled. Then, the coil was subjected to reheating. As hot rolled coils were compared with coils subjected to the reheating treatment with respect to the yield point and the strain aging whereby the results shown in Table 2 were obtained.

More specifically, each of steels (sample Nos. 1 to 11) was an ingot obtained by an ordinary pouring method. The ingot was soaked at 1300° C. for 9.5 hours and bloomed and rolled to form a slab having a thickness of 150 mm. The slat was soaked at 1250° C. for 3 hours in a heating furnace and hot rolled whereby a hot rolled steel plate having a thickness of 6 mm was obtained. The plate was coiled at 550° and 680° C. in case of sample Nos. 1 to 4 or at 500° C. alone in case of sample Nos. 5 to 11. The resulting hot rolled coil was cooled to room temperature, and it was then fed into a heat treatment furnace and reheated at 950° C. for 1 hour. Then, the heat-treated coil was cooled to 300° C. in the furnace, and taken out of the furnace and air-cooled. In this example, the hot rolled coil was subjected to the reheating treatment after it had been cooled to room temperature. In view of the heat loss, however, it is advantageous to subject the hot rolled coil to the reheating treatment just after coiling. In this case, loss of hot by cooling of the coil is prevented.

Figure 2:
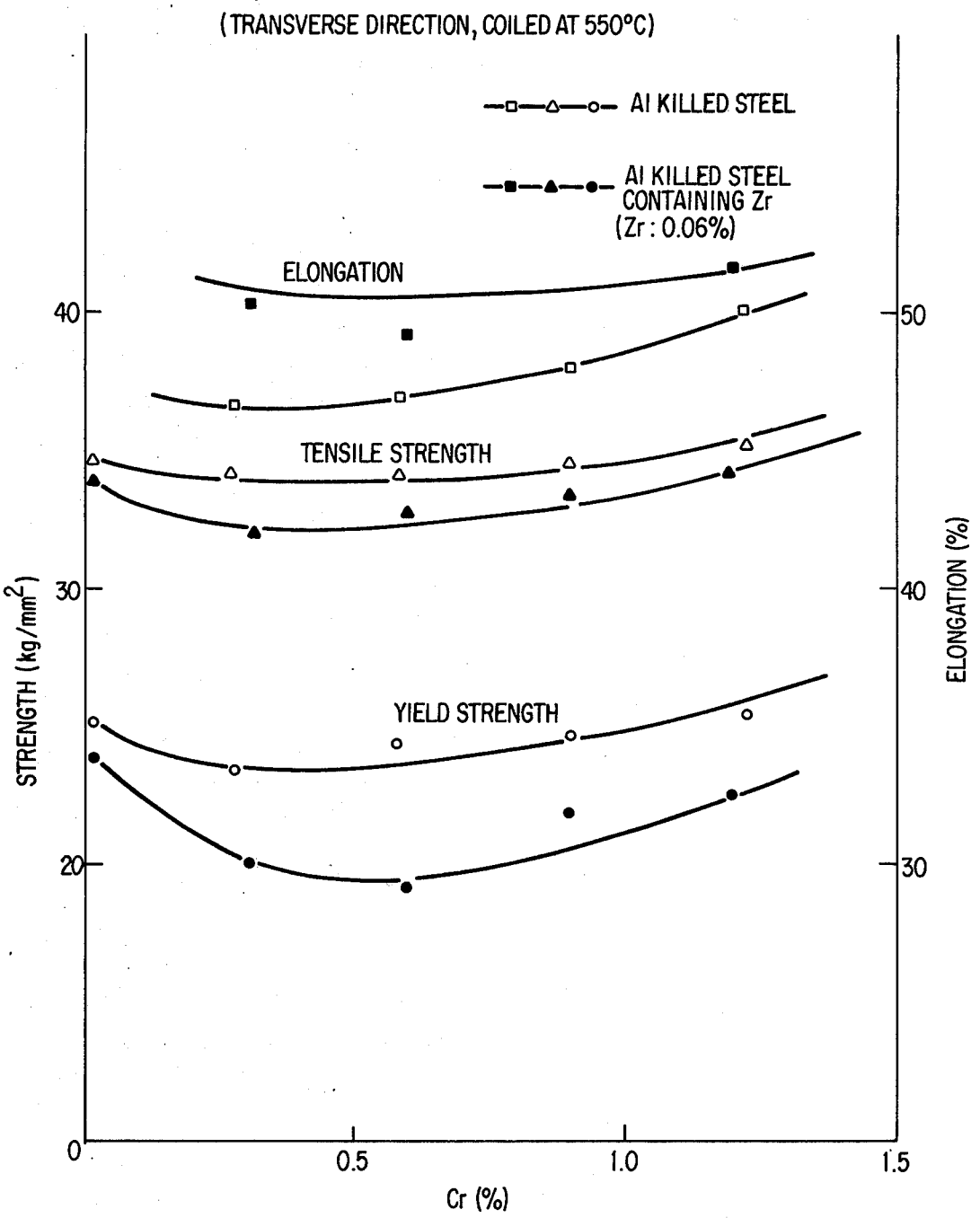

FIGS. 1 and 2 illustrate the relationship between the tensile test values and the Cr content, in hot rolled steels coiled at 550° C.

In these Figs., aluminum killed steels in which Cr alone is incorporated are compared with aluminum killed steels in which Cr and Zr are simultaneously incorporated. If the influence of Cr on the yield point is examined from these Figs., it can be observed that when Cr is incorporated in the, steel the yield point is reduced by about 1.5 to 2.5 Kg/mm$^2$ in either the longitudinal direction or the transverse direction as compared with the case where Cr is not incorporated in the steel, and that when both Cr and Zr are incorporated in the steel, the yield point is further lowered as compared with the case where Zr is not incorporated in the steel and the minimum yield point is 21 Kg/mm$^2$. In general, in hot rolled steels an anisotropy is observed between the longitudinal direction and the transverse direction in connection with mechanical properties such as elongation. In a steel designed to have an excellent workability, such as the steel of the present invention, this anisotropy is undesirable. It can also be observed that by incorporation of Zr, the elongation can be substantially improved and the difference in the mechanical properties between the longitudinal and the transverse direction can be substantially reduced.

Figure 3:
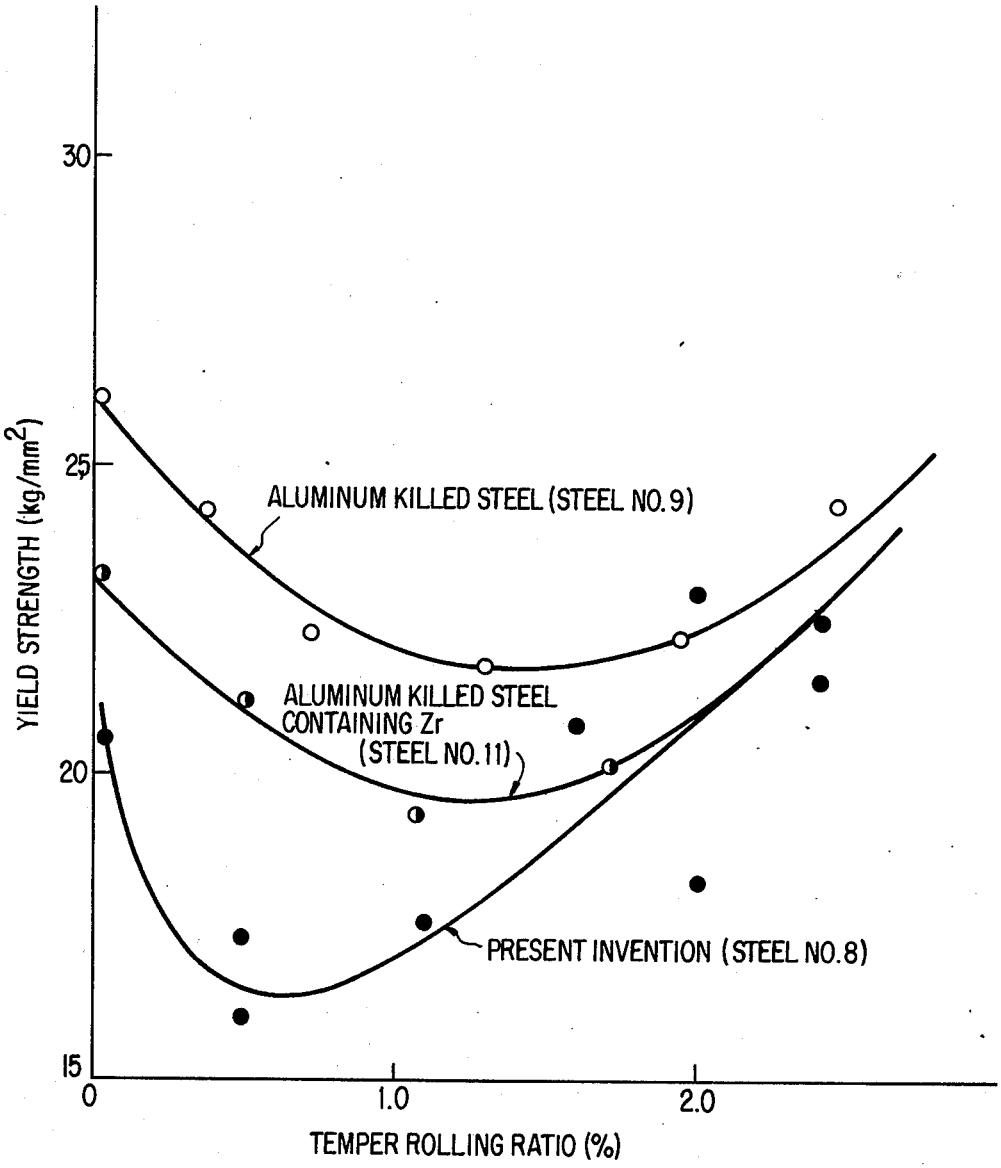
FIG. 3 illustrates the relationship between the temper rolling ratio and the yield point of the steel of the present invention (sample No. 5) and comparative steel samples (sample Nos. 9 and 11).

FIG. 3 illustrates the relationship between the temper rolling ratio and the yield strength, when sample No. 8 of the present invention (containing 0.31% of Cr and 0.04% of Zr) and comparative sample Nos. 9 and 10 were subjected to the temper rolling treatment. From FIG. 3, it can be observed that the yield point is lowest at a temper rolling ratio of about 0.7% and the yield point is reduced by about 6 Kg/mm$^2$ as compared with the as rolled coil and is about 16 Kg/mm$^2$. As the temper rolling ratio is increased beyond this critical point, the yield point is increased again. It is believed that this phenomenon may be caused by work hardening. When the grain of the ferrite structure of the steel is examined according to the method of JIS G-0552 (ferrite grain measuring method), the grain size is about No. 9.0. Such a fine grain structure wich retains a low yield point cannot be observed in any of the comparative steels.

Figure 4:
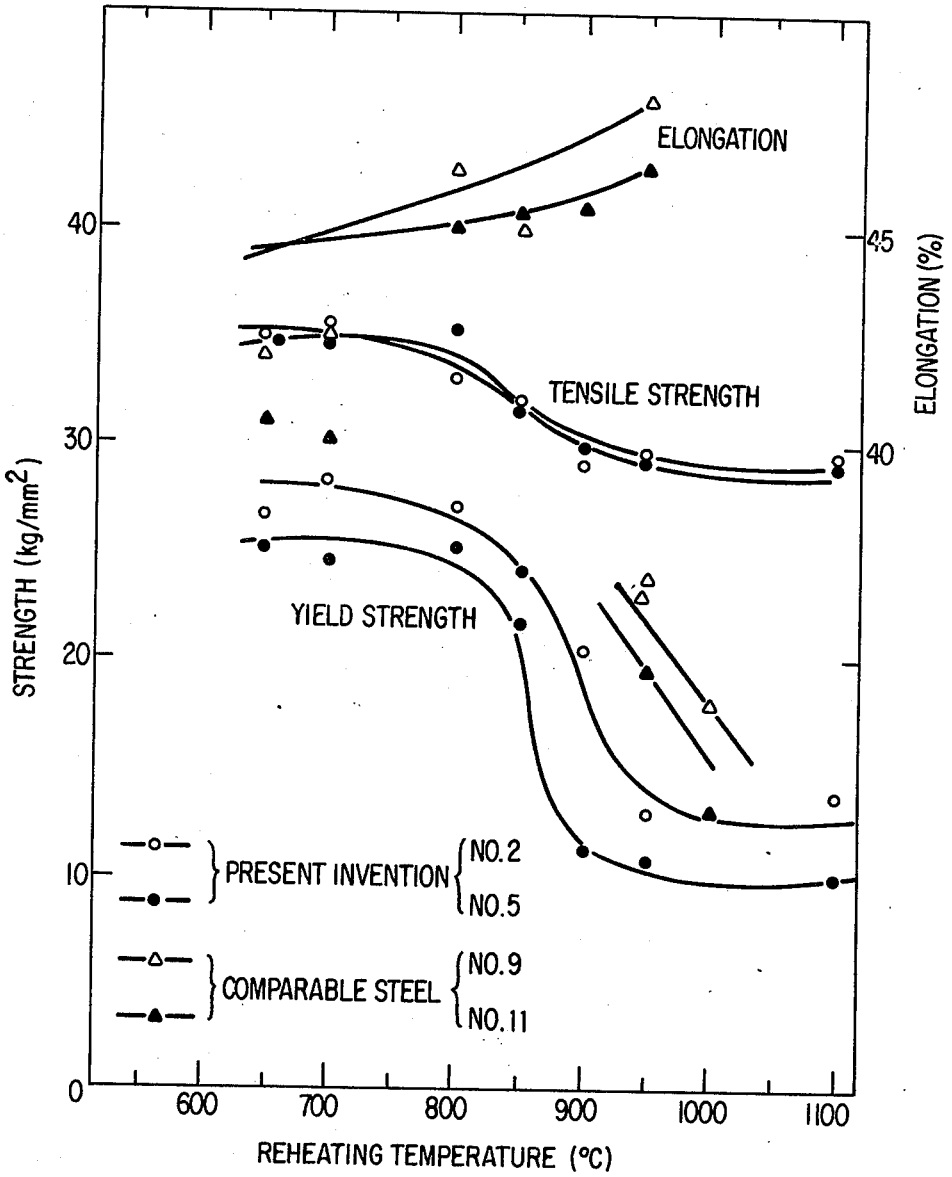
FIG. 4 illustrates the relationship between the tensile strength and reheating temperature of the steels of the present invention (sample Nos. 2 and 5) and comparative steel samples (sample Nos. 9 and 11).
Figure 5:
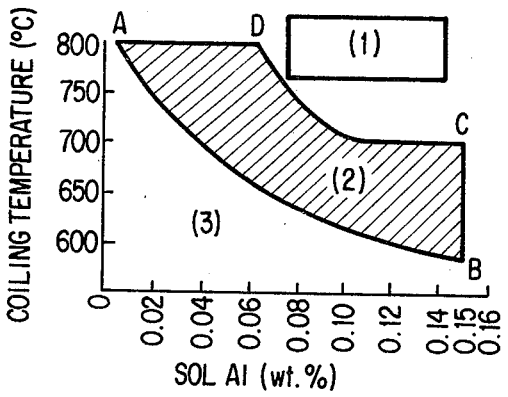
FIG. 5 illustrates the relationship between the sol. Al content and the resulting required coiling temperature of a steel sample prepared according to the prior art procedure Japanese Patent Publication No. 13/74.

FIG. 4 illustrates the relationship between the strength and the ductility of as hot rolled and reheated coils of the steel of the present invention containing 0.55% Cr (sample No. 2) and the steel of the present invention simultaneously containing 0.59% Cr and 0.052% Zr (sample No. 5). From FIG. 4, it can be observed that in sample No. 2 according to the present invention the yield point is remarkably substantially lowered by the reheating treatment at a temperature higher than 900° C. Namely, the yield point is 13.0 Kg/mm$^2$ in case of sample No. 2. In the case of the sample No. 5, the yield point is lowered to 10.6

Kg/mm². On the other hand, the yield points of the comparative sample Nos. 11, 9 and 10 are 20.0, 25.0 and 21.2 Kg/mm², respectively, even after the reheating treatment. Each of the steels of the present invention (sample Nos. 2 and 5) has a very low yield point, and especially in sample No. 5, the yield point is substantially lowered by the simultaneous incorporation of Zr and Cr.

The non-aging properties, which is another characteristic feature of the present invention, will now be described in detail by reference to the results shown in Table 2.

TABLE 2

| Sample Number | Hot Rolled Steel Coils As Rolled Coil: Coiling Temperature (° C) | Yield Point (Kg/mm²) | Strain Aging (Kg/mm²) |
|---|---|---|---|
| 1 | 680 | 23.0 | 0.8 (6.0)* |
| 2 | 680 | 24.0 | 1.1 (5.1)* |
| 3 | 680 | 24.2 | 0.8 (3.8)* |
| 4 | 680 | 24.6 | 0.7 (1.8)* |
| 5 | 550 | 21.0 | 0.3 |
| 6 | 550 | 21.0 | 0.1 |
| 7 | 550 | 20.8 | 0.2 |
| 8 | 550 | 21.3 | 0.3 |
| 9 | 550 | 26.0 | 6.7 |
| 10 | 550 | 24.7 | 5.2 |
| 11 | 550 | 23.0 | 0.2 |

| Sample Number | Hot Rolled Steel Coils As Reheated (after rolling): Reheating Temperature (° C) | Heating Time (hours) | Yield Point (Kg/mm²) | Strain Aging (Kg/mm²) | Remarks |
|---|---|---|---|---|---|
| 1 | 950 | 1 | 13.3 | 0.0 | steel of present invention (Cr incorporated) |
| 2 | 950 | 1 | 13.0 | 0.1 | " |
| 3 | 950 | 1 | 13.2 | 0.3 | " |
| 4 | 950 | 1 | 13.0 | 0.0 | " |
| 5 | 950 | 1 | 10.6 | 0.2 | steel of present invention (Cr & Zr) incorporated) |
| 6 | 950 | 1 | 11.0 | 0.1 | " |
| 7 | 950 | 1 | 10.8 | 0.3 | " |
| 8 | 950 | 1 | 10.6 | 0.0 | " |
| 9 | 950 | 1 | 25.0 | 0.2 | comparison (aluminum killed steel) |
| 10 | 950 | 1 | 21.2 | 0.3 | " |
| 11 | 950 | 1 | 20.0 | 0.4 | comparison (Zr incorporated aluminum killed steel) |

*strain aging when coiled at 550° C

The slab was hot rolled and the hot rolled plate was coiled at 550° or 680° C.

When the strain aging of the steel plates coiled at 550° C. is examined in the Cr-incorporated steels of the present invention (sample Nos. 1 to 4), the Cr- and Zr-incorporated steels of the present invention (sample Nos. 5 to 8) and comparative steels (sample Nos. 9 to 11) in the as rolled state, it can be observed that samples Nos. 1 to 4 have a strain aging in the range of 1.8 to 6.0 Kg/mm², sample Nos. 5 to 8 have a strain aging in the range of 0.1 to 0.3 Kg/mm² and sample Nos. 9 to 11 have a strain aging of 0.2 to 6.7 Kg/mm². Accordingly, sample Nos. 5 to 8 containing both Cr and Zr possess excellent non-aging properties, and sample Nos. 1 to 4 are excellent. It is apparent that when the coiling temperature is fixed (to 550° C.), the strain aging is greatly influenced by the additive components, Cr and Zr. It is estimated that by combined incorporation of Cr and Zr (sample Nos. 5 to 8), gettering of carbon and nitrogen in the steel is further promoted in comparison to the case of single incorporation of Cr and hence, the strain aging is further reduced and the non-aging properties enhanced when Cr and Zr are incorporated simultaneously.

When the relationship between the coiling temperature and the strain aging is examined, it can be observed that when the plate is coiled at 680° C., the strain aging is 0.7 to 1.1 Kg/mm² (sample Nos. 1 to 4) and when the plate is coiled at 550° C., the strain aging is 0.1 to 6.7 Kg/mm² (sample Nos. 5 to 11). Thus, it can be observed that there is a tendency that as the coiling temperature is high, the strain aging is reduced. The reason for this, by reference to sample Nos. 1 to 4 (Cr-incorporated steels), is believed to be as follows.

Even while the hot rolled plate is coiled, carbon and nitrogen in the steel are gettered by Cr. The amount of the carbonitride precipitated is increased as the temperature of the hot rolled steel plate is high, namely as the coiling temperature is high.

In the Cr- and Zr- containing steels of the present invention (sample Nos. 5 to 8), the strain aging is reduced even when the coiling temperature is low (550° C.). Since Zr which was a much higher affinity to carbon and nitrogen is incorporated in the steel, ZrN is already formed even in the soaked state and therefore, even if the plate is coiled at such a low temperature as 550° C., the strain aging property is expelled completely.

As will be apparent from the foregoing illustration, in the present invention, a low carbon aluminum killed steel in which the contents of Si, Mn and the inevitable elements such as P, N and S are reduced as much as possible as the basic composition should be used, and the yield point is substantially reduced by incorporating Cr or Cr and Zr into this basic steel. Further, when the steel of the present invention is subjected to the reheating-soaking treatment at a temperature ranging from 900 to 1100° C., excellent workability and non-aging properties can be obtained. Hot rolled steel plate can be possibly subjected to severe forming such as deep drawing only when the yield point is reduced as low as possible and the non-aging properties are obtained.

What is claimed is:

1. A super mild aluminum killed steel in the form of a hot rolled plate having excellent workability and non-aging properties, which consists in weight percent of up to 0.07% C, up to 0.5% Si, up to 0.5% Mn, 0.005 to 0.1% Al, 0.1 to 1.3% Cr and 0.015 to 0.15% Zr, the balance being Fe and impurities, wherein [C + 1/5 (Si + Mn)] is up to 0.22%.

2. The super mild aluminum killed steel as set forth in claim 1, which contains carbonitrides of Cr and Zr precipitated in the ferrite grain.

3. The super mild aluminum killed steel as set forth in claim 1, wherein the Cr content is preferably in the range of from 0.3 to 0.7%.

* * * * *

UNITED STATES PATENT AND TRADEMARK OFFICE

CERTIFICATE OF CORRECTION

PATENT NO. : 4,127,427

DATED : November 28, 1978

INVENTOR(S) : Hiroshi Hirano et al

It is certified that error appears in the above-identified patent and that said Letters Patent are hereby corrected as shown below:

Column 1: line 11, delete "and/or"

line 17, after "material, insert -- or --.

line 42, delete ","; same line, after "steel" insert --,-- line 49, delete "are"

line 59, after"properties" insert --"--

LINE 67, after 0.1% delete "of"

Column 2: line 1, after "steel" insert --is-- line 19, delete "0.009" and insert --0.09-- line 39, delete "0.009" and insert --0.006-- line 47, after"rolled" delete ","

line 62, after "value" insert --.--

UNITED STATES PATENT AND TRADEMARK OFFICE

CERTIFICATE OF CORRECTION

PATENT NO. : 4,127,427

DATED : November 28, 1978

INVENTOR(S) : Hiroshi Hirano et al

It is certified that error appears in the above-identified patent and that said Letters Patent are hereby corrected as shown below:

Column 2: line 63, delete "found. Accordingly, another" and insert --Moreover, other-- line 63, after "characteristic" insert --s-- line 63, after "except" insert --the $\gamma$-- line 68, delete "not" and insert --now--

Column 3: line 15, delete "being" and insert --and which is-- line 29, after disclosure insert --of the-- line 3, delete ","; same line after "properties" insert --,--

Column 4: line 67, delete "theoretically " and insert --theoretical--

UNITED STATES PATENT AND TRADEMARK OFFICE

CERTIFICATE OF CORRECTION

PATENT NO. : 4,127,427

DATED : November 28, 1978

INVENTOR(S) : Hiroshi Hirano et al

It is certified that error appears in the above-identified patent and that said Letters Patent are hereby corrected as shown below:

Column 5:

line 41, after "G-0555", insert --and-- line 49, delete "is" and insert --in--

Column 7:

line 42, delete "slat" and insert --slab-- line 46, delete "500" and insert --550-- line 56, delete "hot" and insert --heat--

Column 10:

line 49, delete "was" and insert --has--

Signed and Sealed this

*Twenty-fifth* Day of *September 1979*

[SEAL]

*Attest:*

*Attesting Officer*

LUTRELLE F. PARKER

*Acting Commissioner of Patents and Trademarks*